US006153146A

United States Patent [19]

DeMarco

[11] Patent Number: 6,153,146

[45] Date of Patent: Nov. 28, 2000

[54] MOLTEN METAL RECEPTACLE AND SLAG CONTROL BODY TRANSFER APPARATUS THEREFOR

[75] Inventor: Ted C. DeMarco, Avon, Ohio

[73] Assignee: Inland Enterprises, Inc., Avon, Ohio

[21] Appl. No.: 09/133,035

[22] Filed: Aug. 11, 1998

[51] Int. Cl.[7] ..... C21B 3/04

[52] U.S. Cl. ..... 266/230; 266/272

[58] Field of Search ..... 266/227, 230, 266/272; 222/594

[56] References Cited

U.S. PATENT DOCUMENTS

| | | | |
|---|---|---|---|
| 758,199 | 4/1904 | Grapple . | |
| 1,150,581 | 8/1915 | De Lan . | |
| 2,771,316 | 11/1956 | Mitchell . | |
| 3,164,406 | 1/1965 | Barry . | |
| 3,167,345 | 1/1965 | Dukes . | |
| 3,285,650 | 11/1966 | Dukes . | |
| 4,173,366 | 11/1979 | Mattei et al. . | |
| 4,431,169 | 2/1984 | Fuzii et al. . | |
| 4,553,743 | 11/1985 | LaBate, II et al. . | |
| 4,601,415 | 7/1986 | Koffron . | |
| 4,610,436 | 9/1986 | LaBate, II et al. . | |
| 4,637,592 | 1/1987 | LaBate, II et al. . | |
| 4,640,498 | 2/1987 | LaBate, II et al. . | |
| 4,725,045 | 2/1988 | Cutre et al. . | |
| 4,871,148 | 10/1989 | Koffron . | |
| 4,922,994 | 5/1990 | Ogura et al. . | |
| 4,968,007 | 11/1990 | Forte et al. . | |
| 5,044,610 | 9/1991 | Koffron . | |
| 5,249,780 | 10/1993 | Forte et al. . | |
| 5,303,902 | 4/1994 | Forte et al. | 266/230 |
| 5,423,522 | 6/1995 | Forte et al. | 266/230 |
| 5,645,792 | 7/1997 | Forte et al. | 266/230 |

*Primary Examiner*—Scott Kastler
*Attorney, Agent, or Firm*—Watts, Hoffmann, Fisher & Heinke Co., L.P.A.

[57] ABSTRACT

A slag control body transfer and automatic release apparatus for carrying and releasing a slag control body and a molten metal receptacle adapted for subsequently guiding the slag control body are disclosed. The molten metal receptacle includes top and bottom end portions and an interior region therein, the bottom end portion including a discharge nozzle disposed therein for discharging molten metal from the interior region of the molten metal receptacle. A guiding opening is disposed in the top end portion for aligning the slag control body within the opening as the slag control body passes through the opening and subsequently falls into the interior region of the molten metal receptacle. The guiding opening is tapered inwardly in a direction from the top end portion to the bottom end portion. The transfer apparatus includes a hook apparatus that automatically releases the slag control body as the slag control body is lowered towards the inwardly tapered opening.

9 Claims, 3 Drawing Sheets

MOLTEN METAL RECEPTACLE AND SLAG CONTROL BODY TRANSFER APPARATUS THEREFOR

FIELD OF THE INVENTION

The present invention concerns a transfer and release apparatus and a molten metal receptacle adapted to cooperate with the transfer and release apparatus for automatically releasing a slag control body into the molten metal receptacle, and for centering and ensuring accurate placement of the slag control body into the molten metal receptacle.

BACKGROUND OF THE INVENTION

In the continuous casting of metal, molten metal is delivered from a molten metal receptacle, such as a ladle or tundish, to a continuous caster through a discharge nozzle located in the bottom of the molten metal receptacle. A layer of slag comprising metal impurities rides above the top surface of the molten metal within the molten metal receptacle. As the molten metal is discharged from the nozzle it is important to maintain the separation between the slag and molten metal so that the molten metal being discharged is not contaminated by the slag.

The flow of molten metal through the discharge nozzle forms a vortex in the molten metal immediately above the nozzle. If the level of molten metal within the molten metal receptacle is sufficiently high the vortex does not affect the separation of the molten metal and slag. When the molten metal reaches a predetermined critical level, however, the vortex pulls down the slag layer through the center of the vortex and into the nozzle along with the molten metal. As a result, the metal is contaminated by the slag.

A slag control body is operative to inhibit the formation of a vortex in the molten metal. The slag control body is constructed of a refractory material having a density heavier than that of the slag and lighter than that of the molten metal so that the slag control body will tend to sink below the slag layer yet remain above the surface of the molten metal. When the molten metal reaches a predetermined critical level, the slag control body is drawn by the vortex into the nozzle and lodges in the nozzle to obstruct further flow.

A number of transfer and release methods and apparatuses have been developed in the prior art for introducing the slag control body into the molten metal receptacle. One such method is to have an operator climb to the top of the molten metal receptacle by means of a staircase, or the like, located adjacent the receptacle and at the required time drop the slag control body into an opening in a top end portion of the molten metal receptacle. The height of the ladle and the weight of the slag control body make such a task inconvenient and undesirable. Moreover, the high temperatures associated with the molten metal process expose the operator to a hazardous environment.

Overhead cranes have been used to drop the slag control body into the molten metal receptacle. The slag control body is often inadvertently subjected to a slight swinging motion as the crane positions the transfer apparatus making it difficult for the operator to assess whether the slag control body is aligned with the opening in the top end portion. This affects the timing and accuracy of the release of the slag control body. The operator must wait until the slag control body stabilizes above the opening in the top end portion. This is inefficient and can slow down the overall molten process. If the operator drops the slag control body while it is still swinging the slag control body may miss the opening or otherwise be misplaced in the molten metal receptacle. This, in turn, can cause the slag to be pulled into the vortex and contaminate the discharged molten metal since the slag control body may not be appropriately or timely drawn by the vortex into the nozzle.

Another prior art apparatus requires the addition of heavy and intricate parts to be mounted onto the top end portion of the molten metal receptacle. Such parts add cost to the transfer apparatus. The parts also add additional weight to the top end portion making transportation or handling of the top end portion from one location to another more difficult. Moreover, because the parts are mounted on the top end portion, they are exposed to rigorous wear due to the high temperatures involved in the molten metal process and are susceptible to being inadvertently damaged during positioning of the top end portion. In any event, the parts eventually require repair and/or replacement, thus increasing costs.

What is needed is a transfer and release apparatus and a molten metal receptacle adapted to cooperate with the transfer and release apparatus, wherein the transfer apparatus automatically releases the slag control body when the transfer apparatus is lowered onto the top end portion and wherein the molten metal receptacle includes means for thereafter guiding the slag control body into the receptacle. Such a transfer apparatus must be operable from a location remote from the slag control body at an easily accessible position and must also be simple and cost-effective to manufacture and assemble, comprise a minimal amount of parts and be capable of handling the rigors often associated with the molten metal process.

SUMMARY OF THE INVENTION

The present invention utilizes a hook apparatus, described in detail below, for carrying and releasing a slag control body and a molten metal receptacle adapted to guide the slag control body into the molten metal receptacle. The receptacle includes top and bottom end portions and an interior region therein. A discharge nozzle is disposed in the bottom end portion for discharging molten metal from the interior region of the molten metal receptacle. A guiding opening is disposed in the top end portion for aligning the slag control body within the opening as the slag control body passes through the opening and subsequently falls into the interior region of the molten metal receptacle. The opening is tapered inwardly in a direction from the top end portion to the bottom end portion of the receptacle.

In accordance with a feature of the invention, the guiding opening is oriented in the top end portion of the molten metal receptacle so that it is substantially aligned with respect to and above where a vortex flow pattern would ordinarily form by the flow of molten metal through the discharge nozzle. This is preferably accomplished by orienting the top end portion so that it is substantially aligned with the discharge nozzle. The guiding opening can also exhibit various shapes. For example, the opening may be an inverted frustum-shaped opening or a rectangular-shaped opening.

According to another embodiment of the invention, the guiding opening comprises an inwardly tapered opening and a cylindrically-shaped opening substantially aligned with and positioned immediately below the inwardly tapered opening. The cylindrically-shaped opening is operative to centrally align the slag control body within the cylindrically-shaped opening and to guide the slag control body into the interior region of the molten metal receptacle as the slag control body passes through the cylindrically-shaped opening.

The hook apparatus of the present invention includes connecting means, preferably first and second connecting links, for connecting the hook apparatus to a mechanism, such as a crane, for positioning the hook apparatus in proximity to the guiding opening of the molten metal receptacle. First and second suspending hooks are suspended from the connecting means, most preferably in a freely swingable fashion. Each suspending hook has a shank portion and a tip portion. According to a preferred embodiment, the shank portion of the first hook is connected to the first connecting link of the connecting means and the shank portion of the second hook is connected to the second connecting link of the connecting means. The first and second suspending hooks are connected so that the tip portions of the respective suspending hooks are urged together when the suspending hooks are suspended by the connecting means. This is preferably accomplished by pivotally connecting the suspending hooks. The suspending hooks are operative, when urged together, to releasably suspend the slag control body. Although the first and second suspending hooks are most preferably mirror images of each other, the present invention also contemplates use of other types of suspending hooks that are urged towards each other, whether by means of the weight of the suspending hooks or by means of a biasing mechanism, such as a spring or the like.

An outwardly extending member, preferably a bar, is connected to at least one of the first and second suspending hooks. According to a preferred embodiment, each suspending hook includes a respective extending member connected thereto. The extending member can be affixed to or integrally formed with the suspending hook. The extending member is operative to contact, or most preferably slidably engage, a surface proximal to the guiding opening to cause the first and second suspending hooks to urge apart. This surface may comprise a top surface of the top end portion of the receptacle or a contact member spaced apart from the receptacle. The urging apart of the hooks releases the slag control body into the guiding opening in the top end portion.

The transfer and release apparatus of the present invention provides many desirable features and advantages over prior art apparatuses. The slag control body is loaded onto the transfer apparatus simply and quickly at a location remote from the molten metal receptacle. This provides an advantage over prior art apparatuses which require the slag control body to be installed onto a pin mechanism that is mounted to the top end portion wherein the operator must either crawl on top of the molten metal receptacle or remove the top end portion and relocate it to a more accessible position in order to load the slag control body. The present invention allows an operator to load the slag control body as a separate and independent task from removal or installation of the top end portion. The operator is at a location remote from the drop site at an easily accessible position when lowering the slag control body. The transfer apparatus automatically releases the slag control body when the operator lowers the transfer apparatus onto the top end portion. The transfer apparatus is made of a simple construction and comprises a minimal number of parts, making it cost-effective to manufacture and assemble. The transfer apparatus does not require the interaction of intricate parts which, when subjected to the harsh conditions associated with the molten metal process, are subject to corrosion and eventual repair or replacement.

Additional features will become apparent and a fuller understanding obtained by reading the following detailed description made in connection with the accompanying drawings.

BEST MODE OF PRACTICING THE INVENTION

Figure 1:
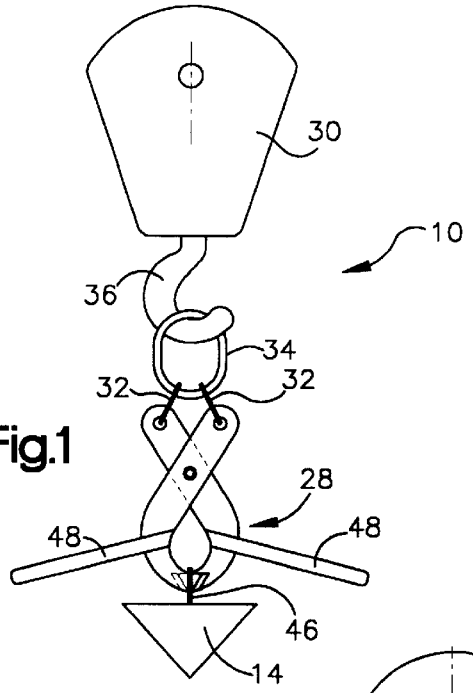
FIG. 1 is a side view of a transfer and release apparatus constructed in accordance with the present invention connected to a positioning mechanism.
Figure 2:
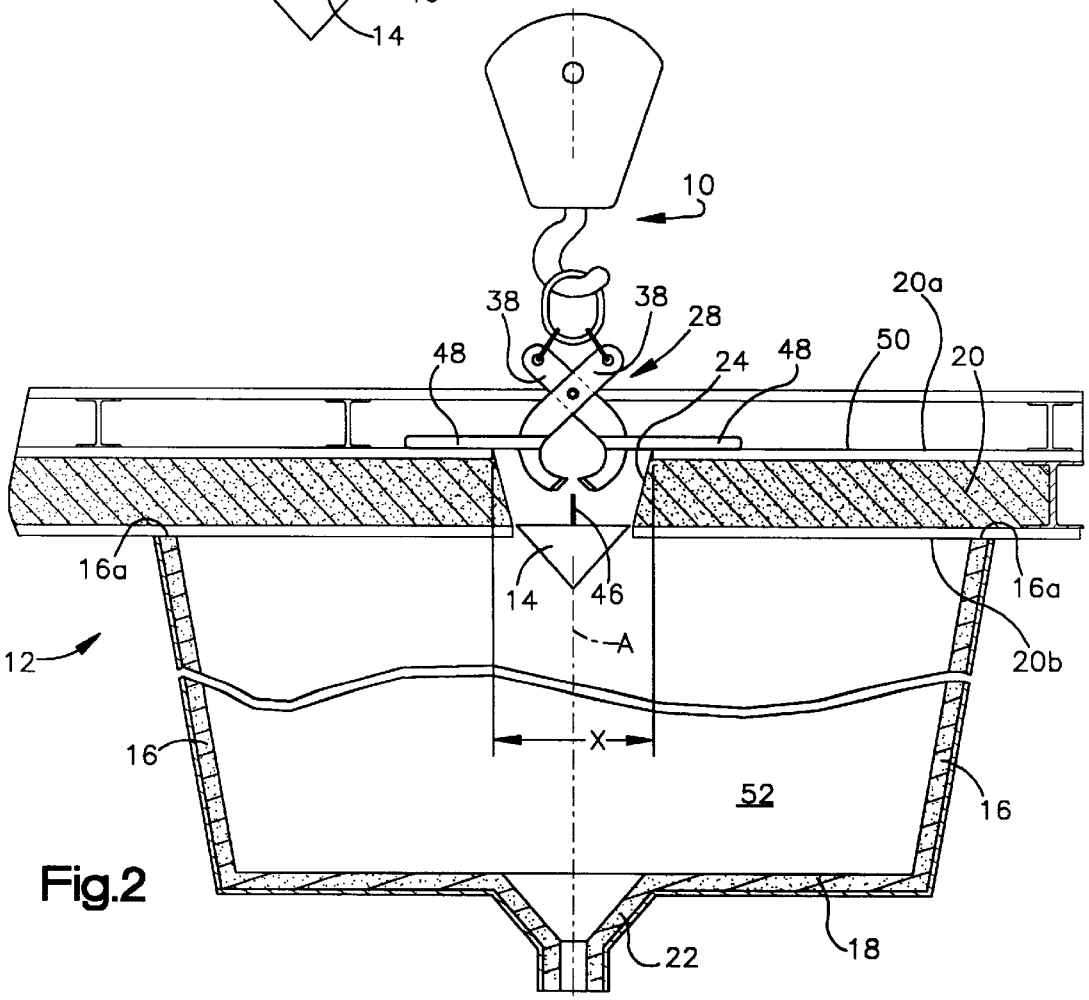
FIG. 2 is a cross-sectional side view of a molten metal receptacle constructed in accordance with an embodiment of the present invention and a side view of the transfer and release apparatus of FIG. 1 shown releasing a slag control body.

FIG. 1 shows a slag control body transfer and release apparatus, generally indicated at reference character 10, and FIG. 2 shows a molten metal receptacle, such as a ladle or tundish, generally indicated at reference character 12, both constructed in accordance with the present invention. In FIG. 1, the transfer apparatus 10 is shown lowering a slag control body 14 and, in FIG. 2, the transfer apparatus 10 is shown subsequently releasing the slag control body 14 into the molten metal receptacle 12. The slag control body 14 is released before the molten metal drops to a predetermined critical level in the molten metal receptacle 12; that is, before the formation of a vortex flow pattern in the molten metal. This critical level may vary depending on such factors as the size, shape, or orientation of the molten metal receptacle 12 or the flow rate of molten metal into and from the molten metal receptacle 12. In accordance with the present invention, the molten metal receptacle 12 is adapted to actuate the transfer apparatus 10 for release of the slag control body 14 when the transfer apparatus 10 is lowered to a predetermined position relative to the molten metal receptacle 12 and to guide the slag control body 14 into the molten metal receptacle 12.

FIG. 2 illustrates a preferred embodiment of the invention. The molten metal receptacle 12 includes side walls 16, two of which are shown in cross section, a bottom wall 18, and a cover 20 disposed on the top edges 16*a* of the side walls 16. The cover 20 is most preferably removably mounted. The walls 16, 18 and cover are made of a refractory material and are about six to ten inches thick. The bottom wall 18 includes a discharge nozzle 22 through which the molten metal in the receptacle 12 is expelled. A guiding opening, or gap 24, is disposed in the cover 20 through which the slag control body 14 is guided before falling into the molten metal receptacle 12. The guiding opening 24 is tapered inwardly in a direction from a top surface 20*a* of the cover 20 to a bottom surface 20*b* of the cover 20. A lid (not shown) is removably mounted on top of the cover 20 to cover the opening 24.

The gap 24 is oriented in alignment with respect to and above where a vortex flow would ordinarily form by the flow of molten metal through the discharge nozzle 22 without a slag control body 14 in place. In the preferred and illustrated embodiment, the tapered gap 24 is oriented in substantial alignment with the discharge nozzle 22, as shown in FIG. 2, along axis A. The tapered gap 24 enables the slag control body 14 to self-align as it passes through the tapered gap 24 so that the center of the slag control body 14 coincides with the center of the "not-yet-formed" vortex in the molten metal immediately above the discharge nozzle 22. Thus, an advantage of the present invention is that the tapered gap 24 provides an advantageously large target drop area for the slag control body 14 which simplifies the aiming task of the operator, whom is usually at a location remote from the tapered gap 24. Another advantage is that the tapered gap 24 removes sway or side-to-side movement caused by movement or other inadvertent bumping in the transfer apparatus 10 or slag control body 14 that may occur when the slag control body 14 is transferred from a remote location to the molten metal receptacle 12.

Figure 3:
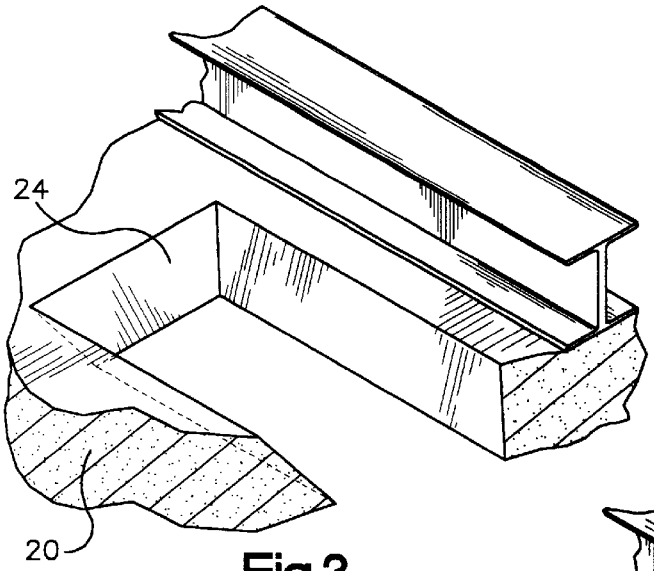
FIG. 3 is a perspective view of a section of a top end portion of the molten metal receptacle.
Figure 4:
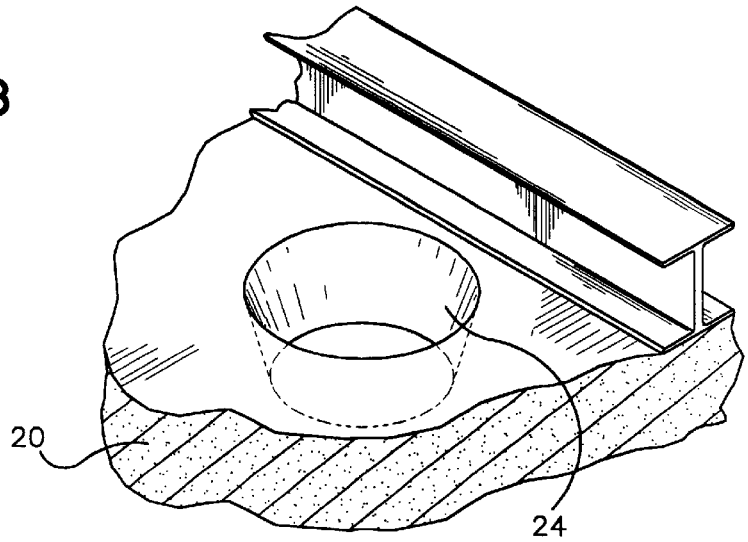
FIG. 4 is a perspective view of a section of a top end portion of another embodiment of the molten metal receptacle.
Figure 5:
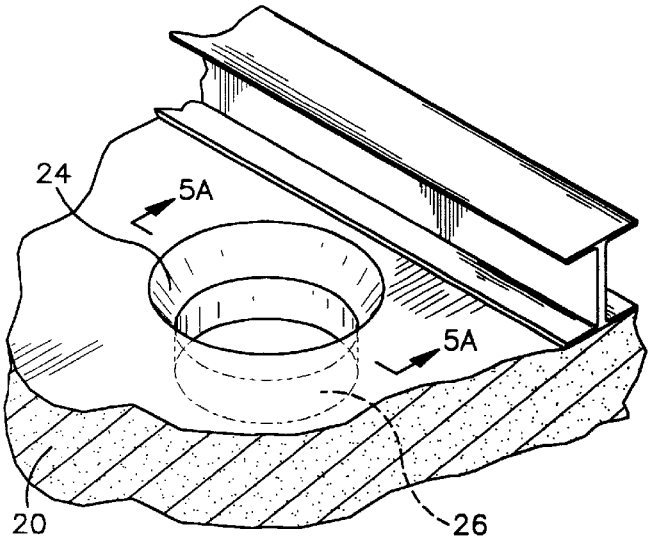
FIG. 5 is a perspective view of a section of a top end portion of yet another embodiment of the molten metal receptacle.
Figure 5A:
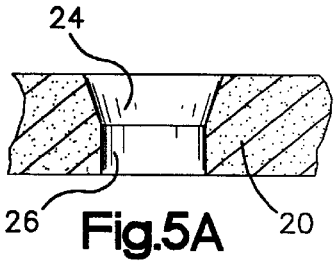
FIG. 5A is a cross-sectional view of the section of the top end portion shown in FIG. 5 as viewed from the plane 5A—5A in FIG. 5.

The shape of the inwardly tapered gap 24 may comprise an elongated passage or a generally rectangular-shaped opening 24, as shown in broken view in FIG. 3. According to a preferred embodiment, the tapered opening 24 is circular (as shown in FIGS. 2 and 4) so as to form a continuous circular tapered wall, or an inverted frustum-shaped opening 24. In an even more preferred embodiment of the invention (as shown in FIGS. 5 and 5A) a cylindrically-shaped opening 26 is included that is substantially concentrically aligned with and oriented immediately below the inwardly tapered opening 24.

The cylindrically-shaped opening 26 is advantageous in that it centers, or aligns, the slag control body 14 as the slag control body 14 passes through the cylindrically-shaped opening 26 and, consequently, further facilitates accurate placement of the slag control body 14 into the molten metal receptacle 12. This is especially advantageous for spherically-shaped or frustoconically-shaped slag control bodies (shown at 14 in FIGS. 1, 2 and 7) wherein the cylindrically-shaped opening 26 can maintain a relatively more precise guided relationship between the opening 26 and the slag control body 14.

Figure 6:
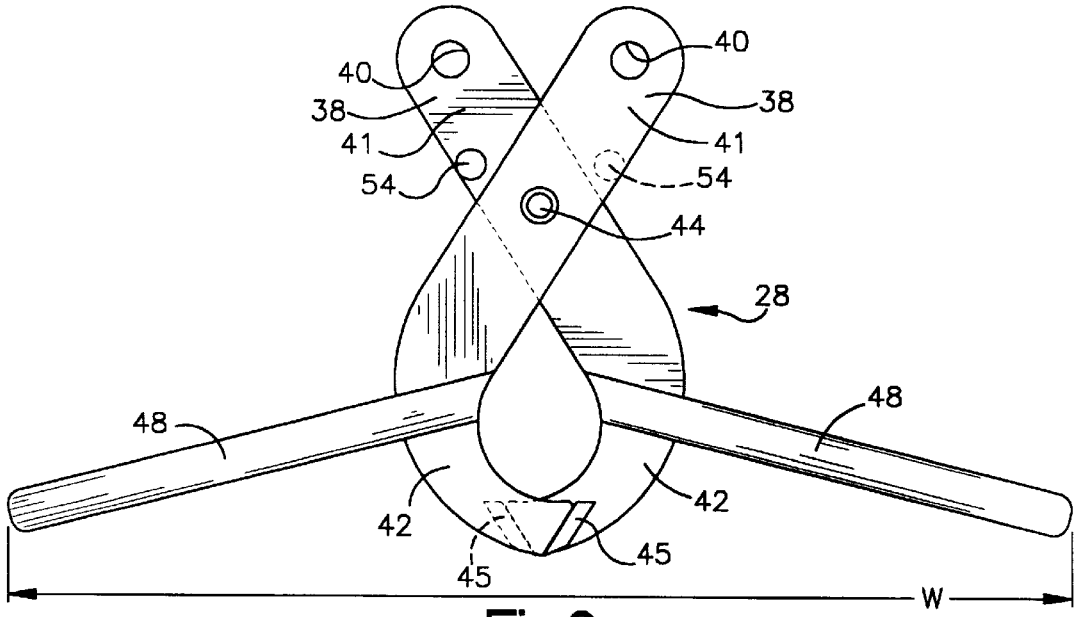
FIG. 6 is a side view of a hook apparatus constructed in accordance with the present invention.

Referring again to FIG. 1, the slag control body 14 is lowered towards the molten metal receptacle 12 by means of a hook apparatus 28 and an overhead crane 30, or similar mechanism for positioning the hook apparatus 28. In the preferred and illustrated embodiment, the hook apparatus 28 includes a pair of connecting links 32 that are freely suspended from and connected to a master link 34. The master link 34 is placed onto the end of a crane hook 36 connected to the overhead crane 30. As shown more particularly in FIG. 6, a pair of suspending hooks 38 include respective holes 40 therethrough through which the connecting links 32 are connected. Each suspending hook 38 includes respective shank portions 41 and tip portions 42. The tip portions 42 are most preferably curved. The suspending hooks 38 are pivotally connected by means of a pivot pin 44 and are arranged so that the tip portions 42 are urged towards each other via the weight of the suspending hooks 38 when the suspending hooks 38 are suspended by the connecting links 32. The tip portions 42 of the suspending hooks 38 include respective raised stop portions 45 protruding from the side of the tip portions 42 for limiting the inwardly urged motion of the suspending hooks 38 to the configuration shown in FIGS. 1 and 6. The slag control body 14 includes an upwardly protruding wire loop 46 through which the tip portions 42 of the suspending hooks 38, when urged together, releasably hold and thereby suspend the slag control body 14.

The suspending hooks 38 include outwardly extending bars 48 connected thereto. The bars 48 are made of metal and are welded to the suspending hooks 38 so that they angle downwardly in the direction of approach when the suspending hooks 38 are in a closed configuration. In other words, the bars 48 are angled downwardly with respect to a plane perpendicular to the line of motion of the transfer and release apparatus 10. The overall width, W, of the extending bars 48 is larger than a width, X, of the guiding opening 24 of the molten metal receptacle 12. This is most clearly shown in FIG. 2. As the slag control body 14 is lowered towards the opening 24, the extending bars 48 slidably engage a top surface 50 of the receptacle cover 20 near the perimeter of the opening 24. This urges apart the extending bars 48 and, accordingly, the suspending hooks 38. As shown in FIG. 2, the width of the suspending hooks 38 when in their open configuration is less than the width of the gap, or opening 24, in the cover 20, thereby allowing a portion of the suspending hooks 38 to extend into the opening 24. The separating, or opening, of the hook apparatus 28 releases the slag control body 14 into the guiding opening 24 whereupon the opening 24 guides the slag control body 14 into an interior region 52 of the molten metal receptacle 12 as hereinbefore described. Further relative pivotal movement between the suspending hooks 38 is limited by a stop pin 54, or other similar type nub element, protruding from the side of the shank portions 40 of the suspending hooks 38 at the location shown most clearly in FIG. 6. As shown in FIG. 2, the extending bars 48 are substantially aligned in the same horizontal plane when the suspending hooks 38 attain an open configuration. This enables the extending bars 48 to engage and lie substantially adjacent to a surface 50 of the cover 20 thereby substantially inhibiting further movement of the hook apparatus 28 into the gap 24.

The transfer and release apparatus 10 of the present invention provides an advantage in that it allows an operator to load the slag control body 14 onto the hook apparatus 28 and crane 30 from ground level, unlike some prior art transfer apparatuses wherein the transfer apparatus is mounted on top of the cover and the cover must be either lowered to the floor or the operator must climb to the top of the molten metal receptacle in order to load the slag control body.

Figure 7:
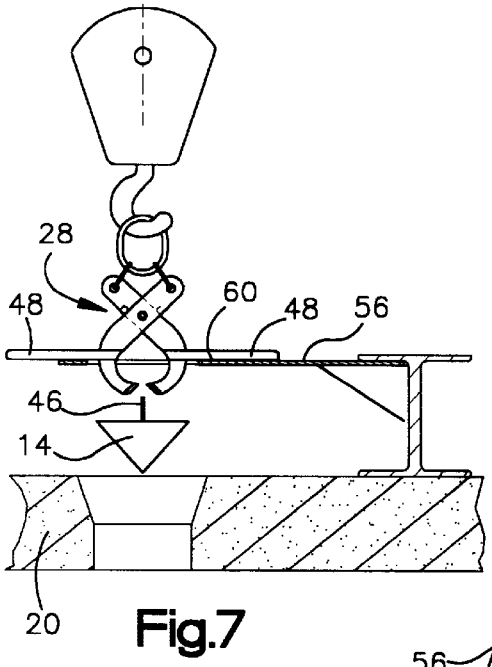
FIG. 7 is a cross-sectional side view of a top end portion of the molten metal receptacle and a contact member constructed in accordance with an embodiment of the present invention and a side view of the transfer and release apparatus of FIG. 1 shown releasing a slag control body.
Figure 7A:
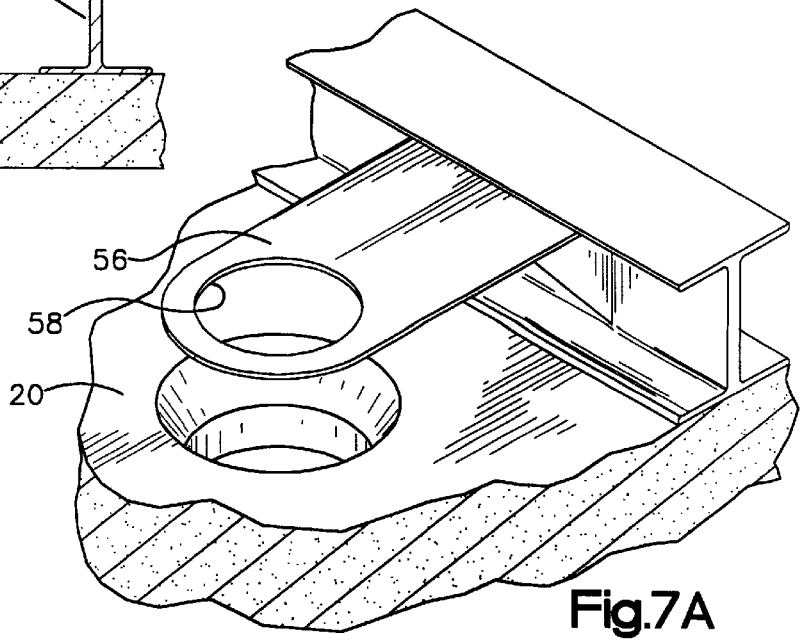
FIG. 7A is a perspective view of a section of the top end portion of the molten metal receptacle and the contact member shown in FIG. 7.

Referring now to FIGS. 7 and 7A, it is seen that an intermediate contact member 56 can be positioned a predetermined distance above the cover 20 to raise the height at which the slag control body 14 is released. Such a contact member 56 is advantageous in environments where there may exist other surrounding hardware that can interfere with the positioning of the hook apparatus 28. The contact member 56 includes an opening 58 through which the slag control body 14 is lowered. The contact member 56 is sized so that the extending bars 48 slidably engage a top surface 60 of the contact member 56 near the perimeter of the opening 58 as the hook apparatus 28 is lowered. The extending bars 48 urge apart the hook apparatus 28 which, in turn, releases the slag control body 14 into the inwardly tapered opening 24 of the molten metal receptacle 12.

While the present invention has been described with a certain degree of particularity, it will be understood by those skilled in the art that various changes and modifications may be made without departing from the scope of the invention as defined by the claims hereinafter set forth.

Having described my invention I claim:

1. A transfer and automatic release apparatus for carrying a slag control body and subsequently releasing the slag control body into a molten metal receptacle having an opening sized to permit insertion therethrough of said slag control body, the release apparatus comprising:

a) a hook apparatus including:

i) connecting means for connecting the hook apparatus to a mechanism for positioning said hook apparatus in proximity to said opening of said molten metal receptacle;

ii) first and second suspending hooks suspended from and connected to said connecting means, each said suspending hook having a shank portion and a tip portion, the shank portions of said first and second hooks being suspended from and connected to said connecting means; said first and second suspending hooks being connected so that said tip portions of said respective suspending hooks are urged together when said suspending hooks are suspended by said connecting means; said suspending hooks being operative, when urged together, to releasably suspend said slag control body;

iii) an outwardly extending member connected to at least one of said first and second suspending hooks; and b) a contact member spaced apart from a top portion of said molten metal receptacle; said extending member being operative as the slag control body is lowered towards said contact member by said hook apparatus to engage said contact member, the engagement of said contact member causing said respective suspending hooks to urge apart and thereby release said suspended slag control body into said opening of said molten metal receptacle.

2. The release apparatus of claim 1, wherein said contact member includes an opening therein sized to permit insertion therethrough of said slag control body, said extending member being operative to engage a surface proximal to said contact member opening.

3. The release apparatus of claim 1, wherein said contact member opening is larger than an overall width of the slag control body and smaller than an overall width defined by said outwardly extending member and said first and second suspending hooks.

4. The release apparatus of claim 1, wherein said extending member is arranged to adjacently contact said stop member after said slag control body has been released from said hook apparatus, thereby substantially inhibiting further movement of said hook apparatus into said contact member opening.

5. The release apparatus of claim 1, wherein said contact member is substantially parallel to said top portion of said molten metal receptacle.

6. The release apparatus of claim 1, wherein said contact member opening and said opening of said molten metal receptacle are of a generally circular shape and are relatively concentrically aligned.

7. The release apparatus of claim 1, wherein said first and second suspending hooks of said hook apparatus include an outwardly extending member.

8. In combination, a slag control body, a slag control body release apparatus for lowering a slag control body and a molten metal receptacle, the molten metal receptacle including top and bottom end portions and an interior region therein, a discharge nozzle disposed in said bottom end portion for discharging molten metal from said interior region of said molten metal receptacle, and a guiding opening disposed in said top end portion for aligning a slag control body within said opening as the slag control body passes through said opening and subsequently falls into said interior region of said molten metal receptacle; the slag control body release apparatus comprising:

alignment means independent and separate from the molten metal receptacle for aligning the slag control body with the guide opening of the molten metal receptacle, wherein said guide opening is tapered inwardly in a direction from said top end portion to said bottom end portion of said receptacle; and release means for releasing the slag body control into the interior region of the molten metal receptacle.

9. The slag control body release apparatus of claim 8 wherein the release means comprises a hook apparatus removed from and positioned relative to the top portion of the molten metal receptacle, the hook apparatus comprising:

a) connecting means for connecting the hook apparatus to a mechanism for positioning said hook apparatus in proximity to said guiding opening of said molten metal receptacle;

b) first and second suspending hooks suspended from and connected to said connecting means, each said suspending hook having a shank portion and a tip portion, the shank portions of said first and second hooks being suspended from and connected to said connecting means; said first and second suspending hooks being connected so that said tip portions of said respective suspending hooks are urged together when said suspending hooks are suspended by said connecting means; said suspending hooks being operative, when urged together, to releasably suspend said slag control body; and c) an outwardly extending member connected to at least one of said first and second suspending hooks, said extending member being operative to engage a surface proximal to said guiding opening, the engagement of said surface causing said first and second suspending hooks to urge apart as said slag control body is lowered towards said guiding opening, thereby releasing said slag control body into the guiding opening of said top end portion.

* * * * *